US006854184B2

(12) United States Patent
DiPalma

(10) Patent No.: US 6,854,184 B2
(45) Date of Patent: Feb. 15, 2005

(54) BLADE COVER FOR CUTTING DEVICE

(75) Inventor: Elaine DiPalma, Saddle Brook, NJ (US)

(73) Assignee: EK Success, Ltd., Clifton, NJ (US)

( * ) Notice: Subject to any disclaimer, the term of this patent is extended or adjusted under 35 U.S.C. 154(b) by 0 days.

(21) Appl. No.: 10/083,760

(22) Filed: Feb. 26, 2002

(65) Prior Publication Data

US 2003/0159293 A1 Aug. 28, 2003

(51) Int. Cl.[7] ..... B26B 3/06; B26B 13/00

(52) U.S. Cl. ..... 30/143; 30/151; 30/287; 30/233; 30/254; 30/29

(58) Field of Search ..... 30/143, 151, 152, 30/164, 29, 155, 286, 260, 349, 341, 27, 84, 287, 262, 233, 539, 254; 132/75.5

(56) References Cited

U.S. PATENT DOCUMENTS 1,783,853 A * 12/1930 Miriello ..... 30/260
2,053,707 A * 9/1936 Farmer ..... 206/349
3,793,726 A * 2/1974 Schrank ..... 30/151
4,062,113 A * 12/1977 Ishida et al. ..... 30/260
4,400,877 A * 8/1983 Gingher, Jr. ..... 30/253
4,495,696 A * 1/1985 Fethke et al. ..... 30/138
4,612,708 A * 9/1986 Hattori ..... 30/260
4,714,159 A * 12/1987 Linden ..... 206/349
4,916,815 A * 4/1990 Ohmura ..... 30/151
5,297,343 A * 3/1994 Melter et al. ..... 30/262

* cited by examiner

*Primary Examiner*—Boyer D. Ashley
(74) *Attorney, Agent, or Firm*—Sofer & Haroun, LLP

(57) ABSTRACT

The present invention is directed to a cutting device including a first blade portion having a handle and a cutting surface and a second blade portion having a handle and a cutting surface. The first and second blade portions are coupled together and intersect at a pivot point. A rivet is mounted through the pivot point attaching the first and second blade portions, where then rivet further comprises a head elevated with respect to the first blade portion. A cover for covering at least a portion of the first and second blade portions is provided. The cover has a rivet head receiving slot so that when the first and second blade portions are in a closed position and when the cover is positioned over the first and second blade portions, the rivet head frictionally engages the receiving slot so that the cover is frictionally attached to the rivet head.

6 Claims, 4 Drawing Sheets

BLADE COVER FOR CUTTING DEVICE

FIELD OF THE INVENTION

This invention relates to a blade cover. More specifically, this invention relates to a blade cover for frictionally engaging a cutting device.

BACKGROUND OF THE INVENTION

There have been many safety features added to cutting devices over time to make their transport and storage safer for the user. One of the improvements includes rounding the blade tips of the cutting device, however, this detracts from the effectiveness of the device when used in highly detailed craft work.

In the case of cutting devices which maintain a sharp point for more accurate cutting, a sheath or cover is sometimes employed when the blades are in a closed position. This provides the user added safety when transporting and storing the cutting device, preventing accidental cuts or scrapes caused by exposed cutting blade tips.

However, the currently used sheathes or covers suffer from the problem of insecure attachment to the cutting device body. This is true particularly in the case of device transport when the cutting blade tips are in the downward facing direction. In the event of a fall the blade cover may slip off and the user may still injure themselves on the exposed cutting blade tips. As such, there exists a need to provide a sheath or cover for cutting device blades which securely attaches to the cutting device.

SUMMARY

The present invention looks to overcome the drawbacks of the prior art and provide a blade cover which is securely attached to the cutting device body.

To this end a cutting device is provided comprised of first and second blade portions each having a cutting surface such that the first and second blade portions meet at an intersection point. A rivet is mounted through the pivot point attaching the first and second blade portions. The rivet further comprises a head elevated with respect to the blade portions.

A cover is provided, covering at least a portion of the first and second blade portions where the cover has a rivet head receiving slot so that when the first and second blade portions are in a closed position and when the cover is positioned over the first and second blade portions, the rivet head frictionally engages the receiving slot so that the cover is frictionally attached to the rivet head.

DETAILED DESCRIPTION

Figure 1:
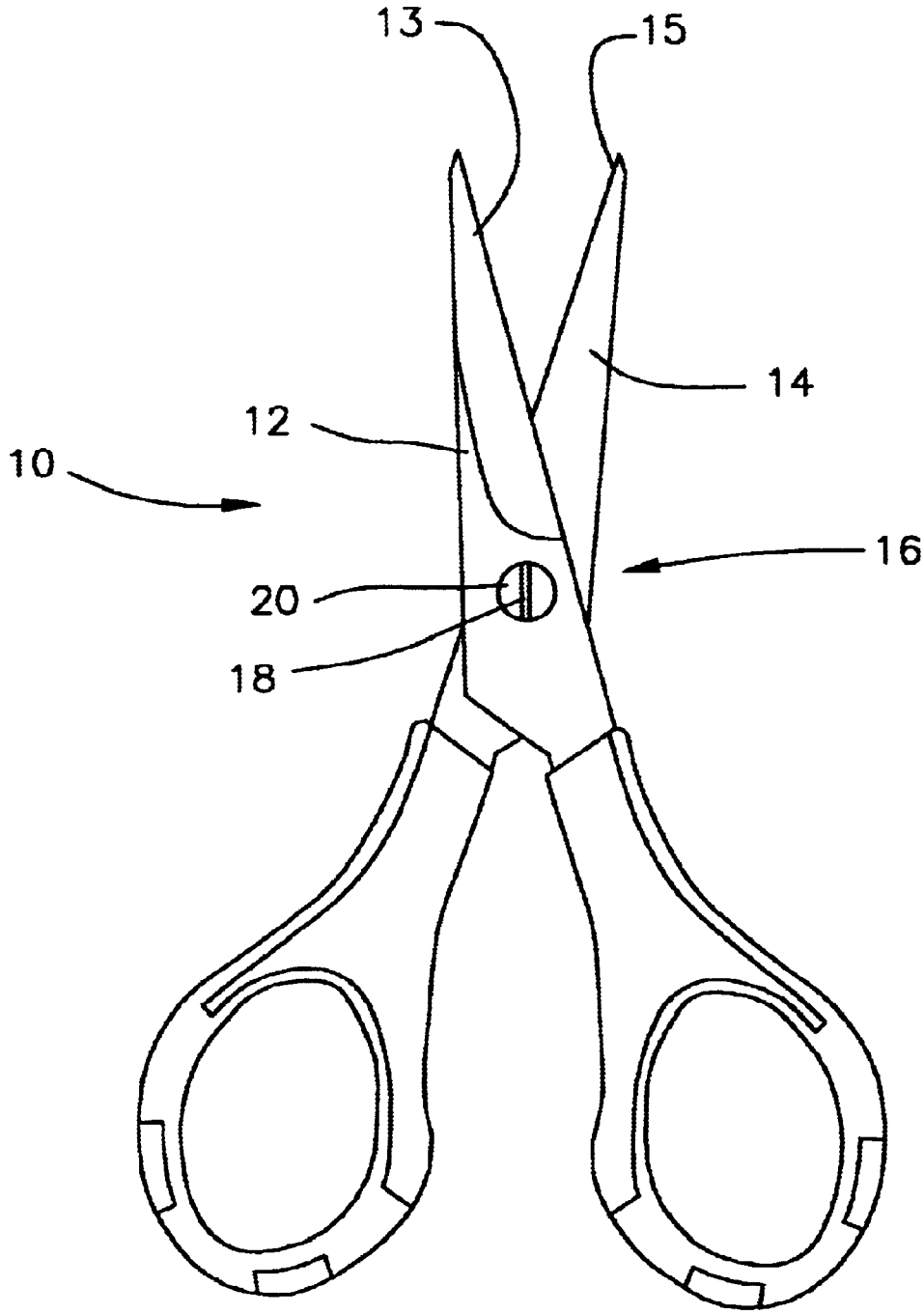
FIG. 1 illustrates an front elevation of an cutting device, in accordance with one embodiment of the present invention.

In one embodiment of the present invention as illustrated in FIG. 1, a cutting device 10 is illustrated having a first blade portion 12 with a first cutting surface 13 and a second blade portion having a second cutting surface 15. First and second blade portions 12 and 14 meet at a pivot point 16 where a rivet 18 connects first and second blade portions 12 and 14. For the purposes of illustration cutting device 10 refers to a craft scissor as illustrated in FIGS. 1–4, however, it should be noted that any similar cutting device 10 having a similar blade configuration is within the contemplation of the present invention.

Rivet 18 maintains a rivet head 20 which is disposed away from the surface of first blade portion 12. It should be noted that rivet head 20 of rivet 18 may be located on the opposite side such that rivet head 20 is disposed away from the surface of second blade 14, however since the rivet head position is interchangeable between first and second blade portions 12 and 14 on device 10, for the purposes of illustration, rivet head 20 is disposed apart from the surface of first blade portion 12.

Figure 4:
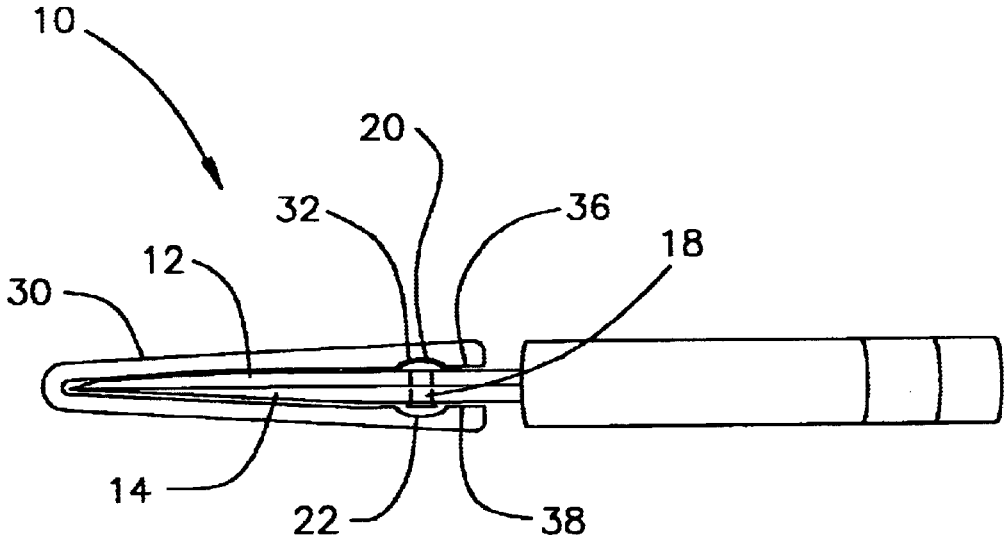
FIG. 4 illustrates a vertical axis cross section of a cutting device with a cover, in accordance With another embodiment of the present invention.

Rivet 18 also maintains a rivet back 22, illustrated in FIG. 4, disposed on the back side of rivet 18 on second blade portion 14 of cutting device 10 for securing first and second blade potions to one another. Rivet 18 is preferably constructed of metal, however any material which adequately secures first and second blade portions 12 and 14 to one another is within the contemplation of the present invention.

Figure 2:
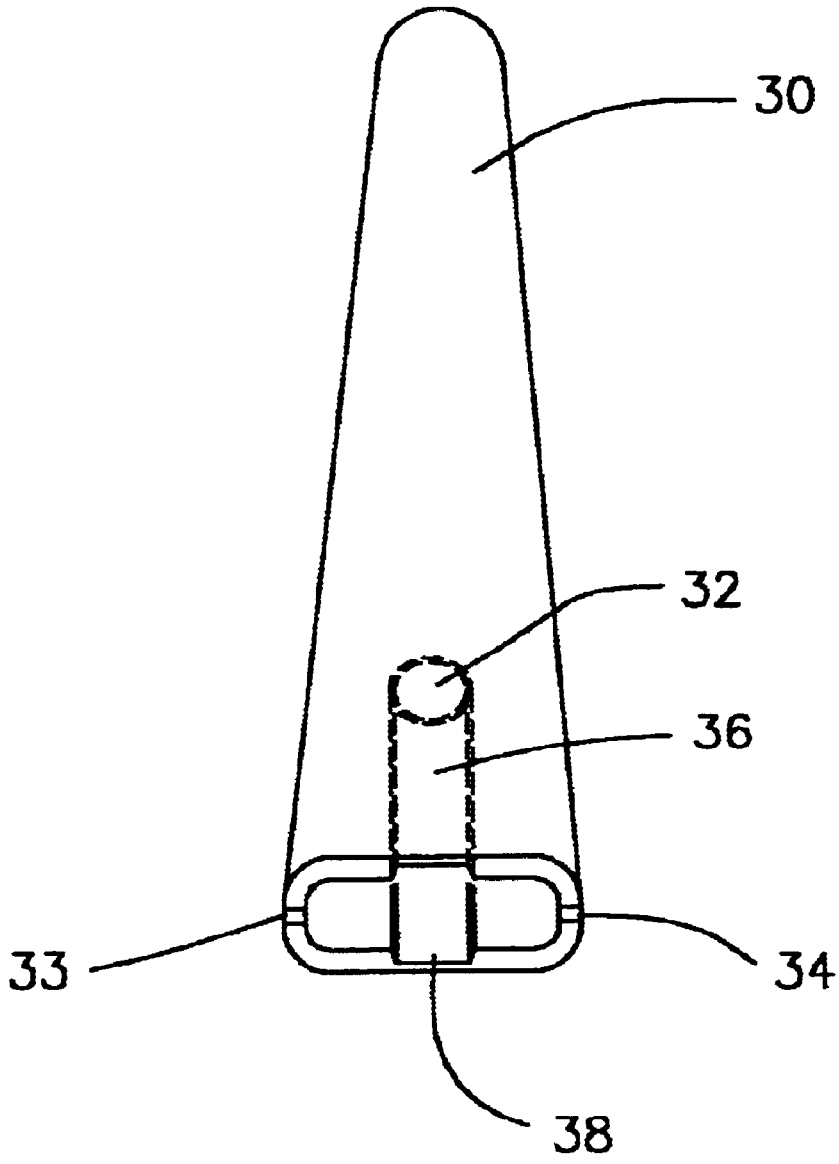
FIG. 2 illustrates angled front elevation of a blade cover, in accordance with one embodiment of the present invention.
Figure 3:
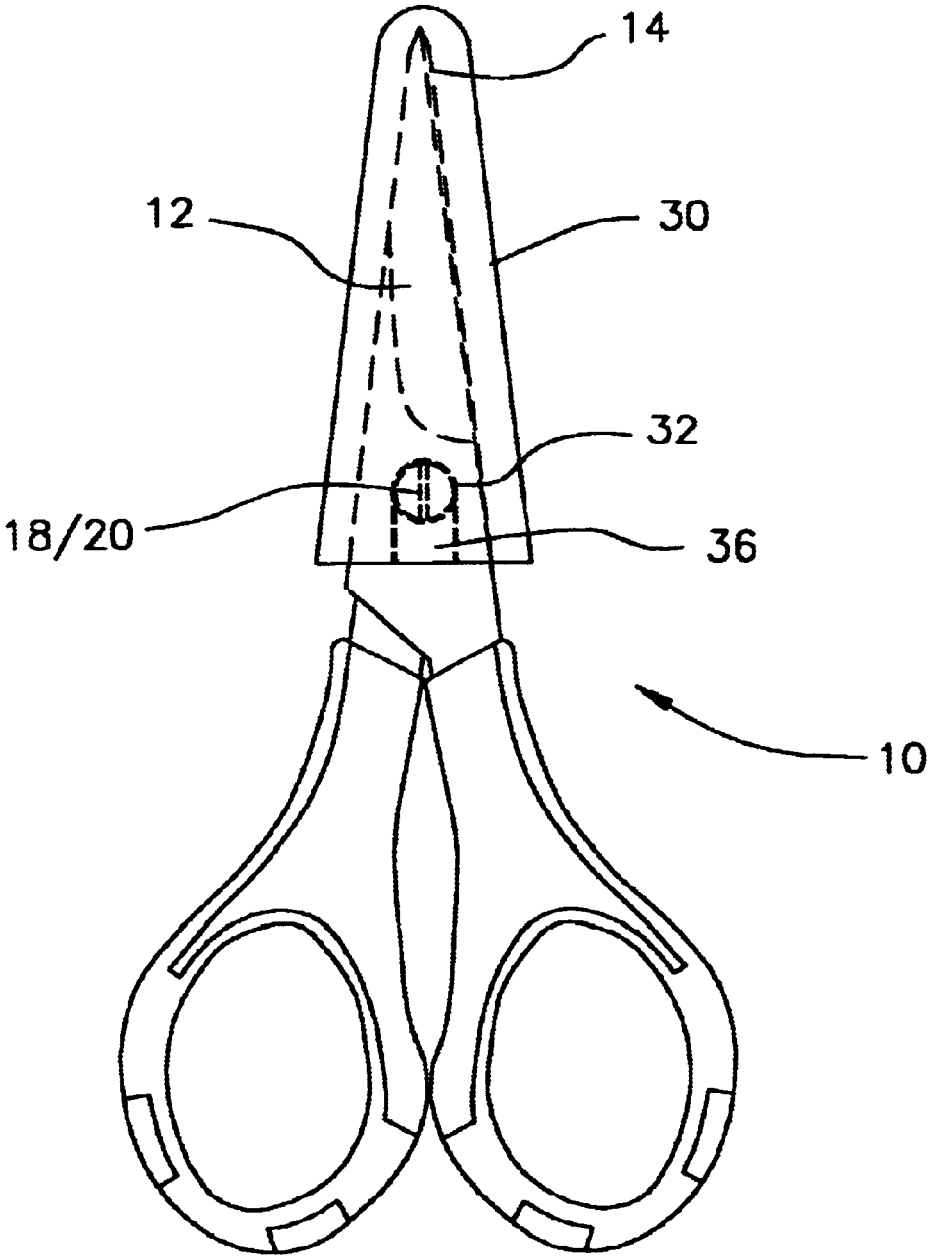
FIG. 3 illustrates front elevation of a cutting device with a cover, in accordance with another embodiment of the present invention.

In one embodiment of the present invention, as illustrated in FIG. 2, a cover 30 is provided which is substantially similar to the shape of first and second blade portions 12 and 14 such that when first and second blade portions 12 and 14 are in the closed positions and first cutting surface 13 is frictionally engaged with second cutting surface 15, cover 30 fits over first and second blade portions 12 and 14 protecting the user from accidental contact with sharp edges. Cover 30 is preferably constructed of plastic however, any material which adequately protects a user from the sharp edges of first and second blade portions 12 and 14 is within the contemplation of the present invention.

In another embodiment of the present invention, as illustrated in FIG. 2, a rivet head receiving slot 32 is formed on one side of cover 30 and configured to frictionally engage rivet head 20 so as to securely fasten cover 30 to cutting device 10. As illustrated in FIG. 2, rivet head receiving slot 32 is round, however this is no way intended to limit the scope of the present invention. For example, in the case where rivet head 20 was square, rivet head receiving slot 32 would also be square. Any shape rivet head receiving slot 32 which is capable of frictionally engaging rivet head 20 is within the contemplation of the present invention.

As illustrated in FIGS. 2, cover 30 further maintains a first and second side slits 33 and 34 disposed on either side of cover 30 configured to allow the bending of cover 30 so as to allow rivet head 20 fit into the bottom opening of cover 30. Further to this end, a rivet head channel 36 is disposed on the upper side of cover 30 from the bottom opening to rivet head receiving slot 32 so as to allow rivet head 20 pass through cover 30 until it reaches rivet head receiving slot 32. Rivet head channel 36 is of a lesser thickness than the rest of cover 30 but is thicker than rivet head receiving slot 32 such that when rivet head 20 reaches rivet head receiving slot 32 rivet head 20 frictionally engages cover 30.

In another embodiment of the present invention, as illustrated in FIG. 2, cover 30 further maintains a rivet back channel 38 on the bottom side of cover 30 similar to rivet head channel 36 such that rivet back 22 does not interfere with the operation of cover 30.

In operation, first and second blade portions 12 and 14 are placed in the closed position such that first and second cutting surfaces 13 and 15 are frictionally engaged. As illustrated in FIG. 4, cover 30 is then placed over first and second blade portions 12 and 14 such the rivet head is placed in rivet head channel 36 and rivet back 22 is placed in rivet back channel 38. Cover 30 is pressed down onto first and second blade portions 12 and 14 until rivet head 20 exits rivet head channel 36 and reaches rivet head receiving slot 32 frictionally engaging cover 30 to device 10. In this position cover 30 is securely fastened to cutting device 10 such that cover 30 will not accidentally fall off during transport or storage of cutting device 10.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A cutting device comprising:

a first blade portion having a handle and a cutting surface;

a second blade portion having a handle and a cutting surface, said first and second blade portions coupled together and intersecting at a pivot point;

a rivet mounted through said pivot point thereby attaching said first and second blade portions, said rivet further comprising a head elevated with respect to said first blade portion; and a cover having a first thickness, for covering at least a portion of said first and second blade portions, said cover having first and second ends, where said first end is closed and said second end is open for receiving said first and second blade portions, said second end further providing an arrangement for receiving and securing said rivet head, said arrangement having a rivet head channel extending from the edge of said second end of said cover towards said first end, where said rivet head channel is of a second lesser thickness than said cover to accommodate the easy entry of said rivet head, said arrangement also having a rivet head receiving slot, said rivet head receiving slot being of a third lesser thickness than said rivet head channel, and located at the end of said rivet head channel closer to said first end of said cover so that when said first and second blade portions are in a closed position and when said cover is positioned over said first and second blade portions, said rivet head frictionally engages between said rivet head receiving slot and said thicker rivet head channel so that said cover is frictionally attached to said rivet head.

2. The cutting device of claim 1, wherein said cover is constructed of plastic.

3. The cutting device of claim 1, wherein said rivet is constructed of metal.

4. The cutting device of claim 1, wherein said cover further comprises first and second side slits configured to allow said cover to expand to allow said rivet head access to said rivet head receiving slot.

5. The cutting device of claim 1, wherein said rivet further comprises a rivet back.

6. The cutting device of claim 5, wherein said cover further comprises a rivet back channel so as to prevent said rivet back from interfering with the operation of said cover.

* * * * *